US005649870A

United States Patent [19]

Harrison

[11] Patent Number: 5,649,870

[45] Date of Patent: Jul. 22, 1997

[54] ELONGATED GOLF CLUB PUTTER

[76] Inventor: Alden J. Harrison, P.O. Box 1491, 20 Jay Dee La., North Eastham, Mass. 02651

[21] Appl. No.: 644,427

[22] Filed: May 10, 1996

[51] Int. Cl.[6] ..... A63B 69/36; A63B 53/16

[52] U.S. Cl. ..... 473/239; 473/296; 473/276

[58] Field of Search ..... 473/293, 294, 473/204, 296, 206, 239, 276, 242, 251, 298, 227, 313, 314, 340, 300, 305, 243; 273/83

[56] References Cited

U.S. PATENT DOCUMENTS

| | | | |
|---|---|---|---|
| 3,188,086 | 6/1965 | Parmley | 273/81.3 |
| 3,528,660 | 9/1970 | Kategian | 473/296 |
| 3,679,207 | 7/1972 | Florian | 473/293 |
| 3,874,668 | 4/1975 | Flege | 473/227 |
| 4,163,554 | 8/1979 | Bernhardt | 273/80 C |
| 4,411,429 | 10/1983 | Drew et al. | 473/80 C X |
| 4,592,552 | 6/1986 | Garber | 273/80 CY |
| 4,712,798 | 12/1987 | Preato | 473/239 |
| 5,029,860 | 7/1991 | Ehrich | 473/296 |
| 5,083,779 | 1/1992 | Ungermann | 473/239 |
| 5,156,401 | 10/1992 | Hodgkiss | 473/227 |
| 5,209,474 | 5/1993 | Voyer | 273/80 C |
| 5,253,868 | 10/1993 | Baumann et al. | 273/80 R |
| 5,282,619 | 2/1994 | Napolitano | 473/239 |
| 5,328,185 | 7/1994 | Finnigan | 473/294 |
| 5,415,399 | 5/1995 | Kettelson | 473/341 |
| 5,465,971 | 11/1995 | Tischler | 473/276 |
| 5,544,879 | 8/1996 | Collins | 473/316 |

OTHER PUBLICATIONS

Golf Digest 1979 Jan. Bill Viele and Hishong Putter, pp. 23–24.

Golf Digest 1988 Feb. New Tricks by Old Dogs, pp. 110–114.

Golf Magazine 1992 Mar. On The Putting Edge, p. 108.

*Primary Examiner*—Sebastiano Passaniti

[57] ABSTRACT

A golf club putter having an elongated shaft that is used in a manner that insures a golfer putts with a pendulum type stroke, as recommended by many Professional Golf Association teaching professionals. The elongated putter consists of two tapered shaft sections where a smaller lower section can collapse inside a larger upper section, a putter head affixed to the bottom end of the lower section, a elongated grip extending down from the top of the upper shaft section and a 30 degree bend at the bottom of the lower shaft section for proper alignment of the putter head when the golf club is held in position for putting. During putting, the elongated putter is positioned with the upper end of the shaft in the golfer's forward arm pit, or, for taller players, up under the forward arm against the side of the chest. The golfer's hands are positioned on the grip in the middle of the shaft to guide the putter along a line that will direct a ball towards the hole. The unique method of putting combined with the golf club putter described by the invention enables a golfer to utilize the large muscles of the shoulders and arms for improved consistency and control while improving accuracy by minimizing movement caused by the smaller muscles of the wrists and hands.

5 Claims, 4 Drawing Sheets

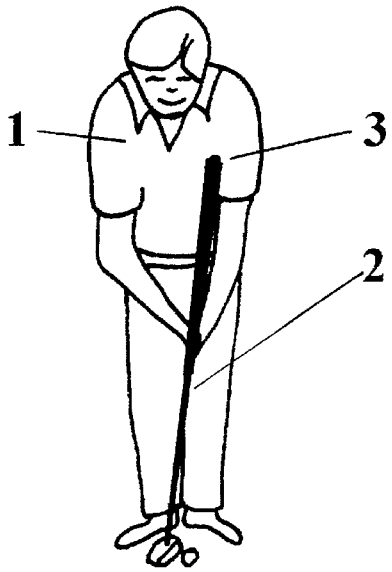
Fig. 1
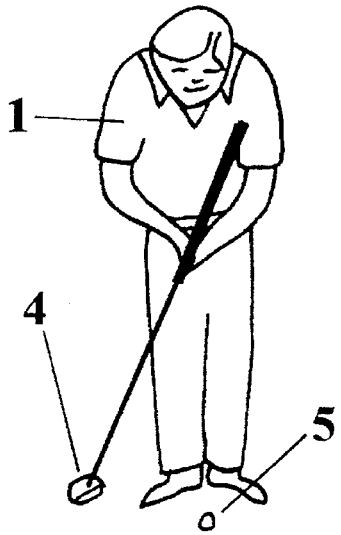
Fig. 2-A
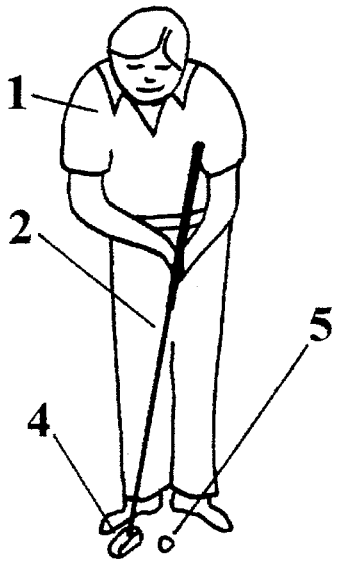
Fig. 2-B
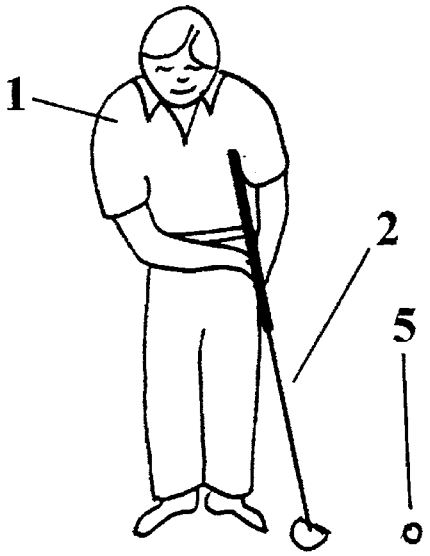
Fig. 2-C

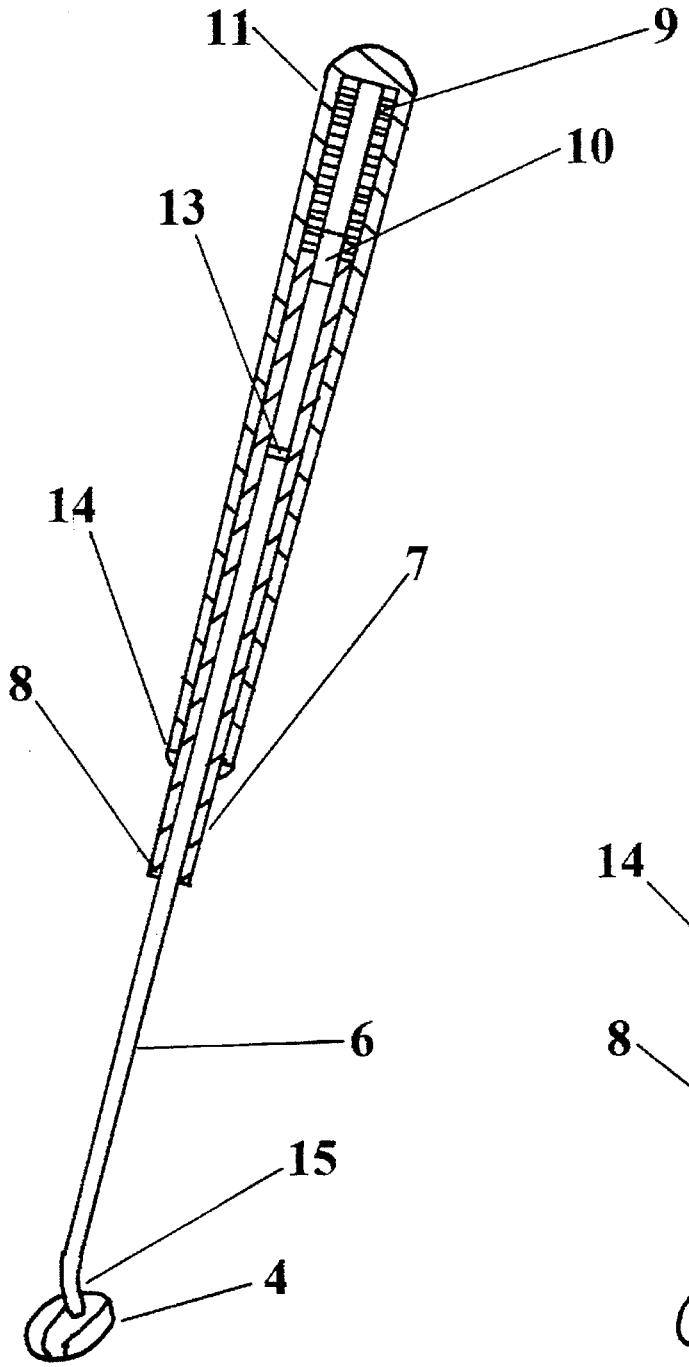
Fig. 3-A
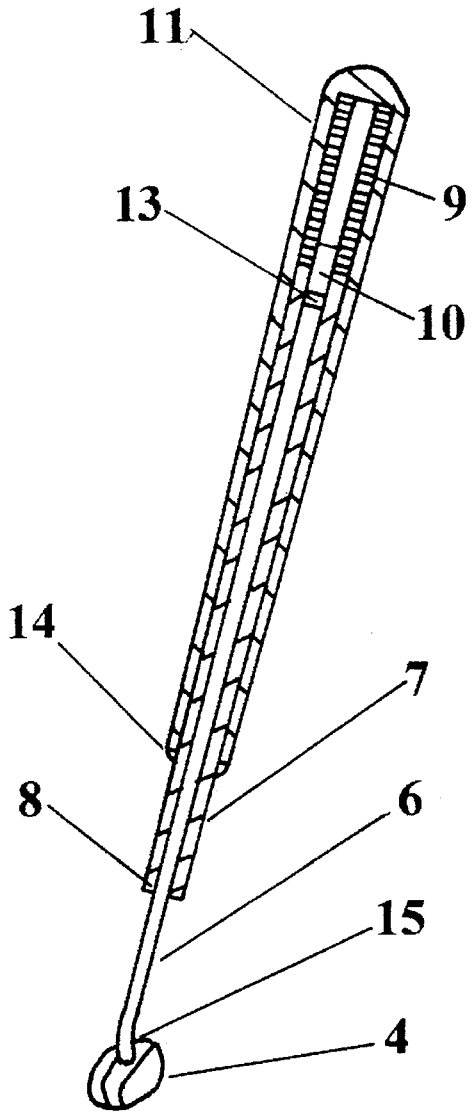
Fig. 3-B

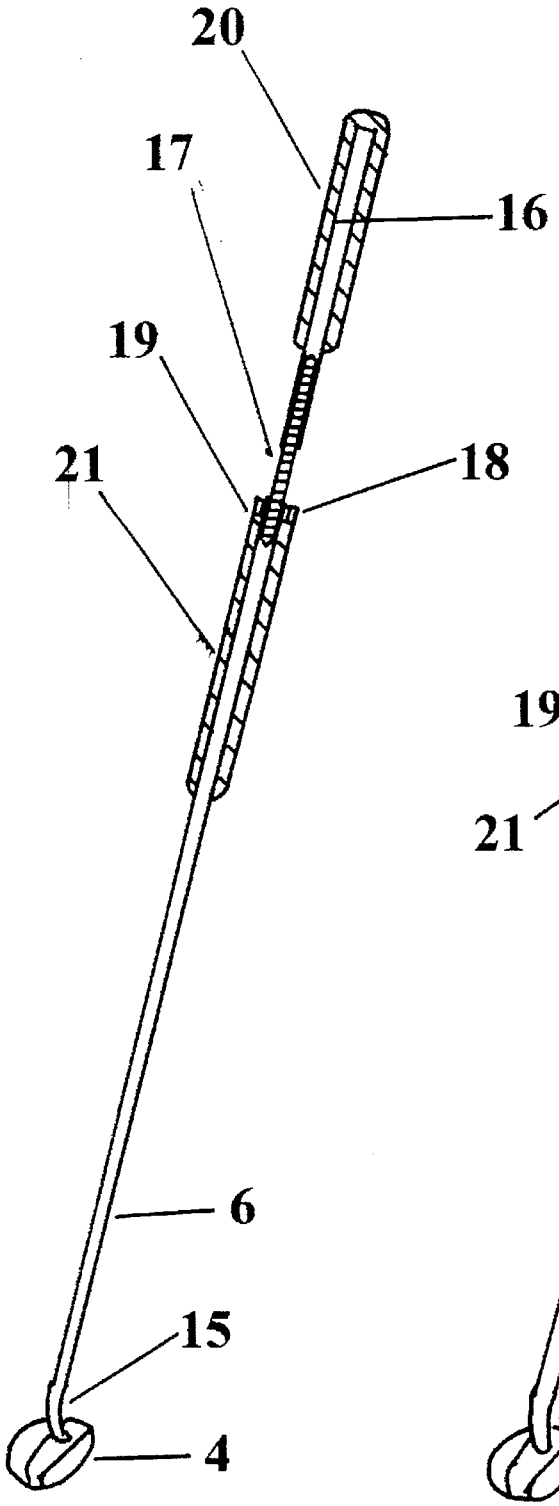
Fig. 4-A
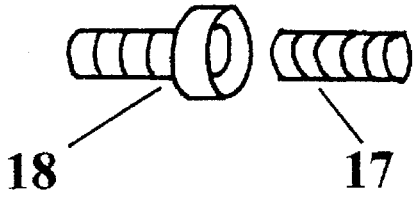
Fig. 4-B
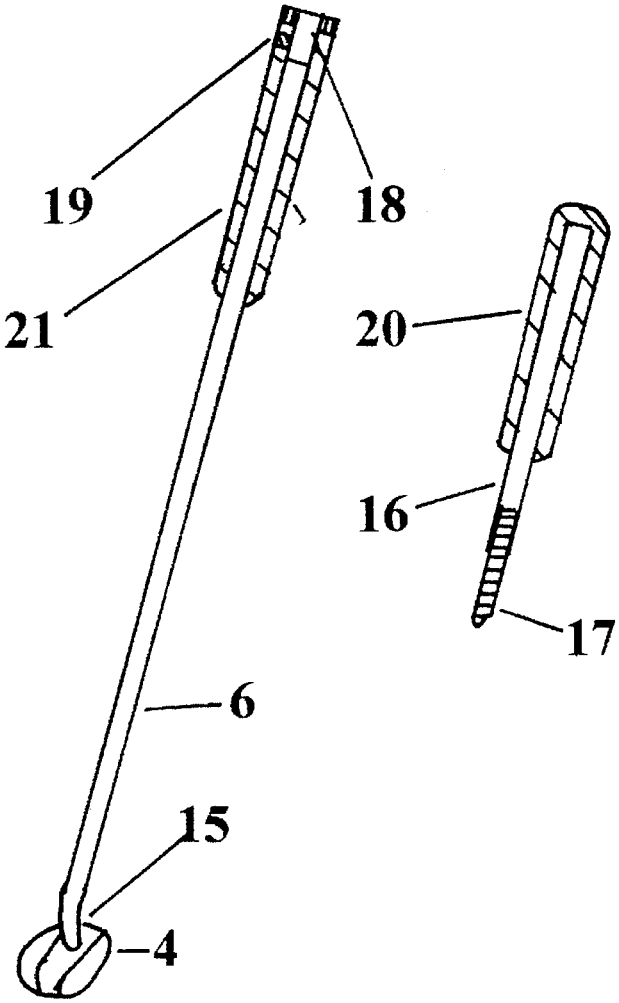
Fig. 4-C

ELONGATED GOLF CLUB PUTTER

BACKGROUND

1. Field of Invention

The invention relates to a elongated golf club putter that is used in a unique manner that enables the user to putt with improved control, better accuracy and a high degree of consistency over existing standard length and elongated putters.

2. Description of Prior Art

Golf is a sport that is played outdoors by individuals (golfers) on land laid out in the form of golf holes each of which have a starting point (tee) and ending point (green). The object of the game is to use the clubs to get the ball into the cup on each hole in the least amount of strokes. The score is the total strokes used to complete (play) the golf course. A golf course consists of eighteen holes (some courses are only 9 holes) where par is typically 72 strokes (or 36 for 9 holes). The golfer plays the sport using golf clubs (14 maximum) and a ball (golf ball) as defined by the United States Golf Association Rules of Golf. The golf clubs typically consist of 10 irons, 3 woods and 1 putter. The woods are used for long distance (off the tee), the irons are used for mid to short distances (hitting to the green) and the putter is used to get the ball into the cup (hole) once you're on the short grass on the green. In a typical round of golf, the putter is used as much as all the other clubs combined i.e. 36 strokes when par is 72. Being able to putt well is a key factor in achieving a low score.

Putters available today generally fall into two categories. One is the conventional length putter that the golfer uses in a manner that requires the hands to grip the top of the shaft and swing the club with extended arms along a predetermined line that will cause the ball to go into the hole. Variations of this method of putting exist in the manner in which the golfer holds the golf club such as griping the shaft with one hand while griping the arm with the other hand. The problem with these methods of putting using conventional length putters is the small muscles of the wrists and hands are used to execute the swing which offers less control over finely focused skilled motor behavior resulting in the possibility of involuntary movement in the course of executing the putt. The result is lack of accuracy, inconsistent performance and generally a high number of missed putts.

The other type of putter available on the market today is the elongated putter that is used with shaft held in a vertical position with the club head perpendicular to the ground and the club face aligned to the ball. The golfer grips the shaft with one hand in the middle of the shaft and the other hand on the top of the shaft and swings the club with the arms along a predetermined line that will cause the ball to go into the hole. The problem with this method of putting using a elongated putter is the golfer is using the small muscles of the wrists and hands to execute the swing which offers less control over finely focused skilled motor behavior resulting in the possibility of involuntary movement in the course of executing the putt. The result, similar to conventional length putters, is a lack of accuracy, inconsistent performance and generally a high number of missed putts.

Also, with elongated putters, the overall length of the shaft is longer than the other golf clubs used to play the game and often presents a problem with transport both when used on the golf course between holes and when traveling between golf courses.

OBJECTS AND ADVANTAGES

Besides the objects and advantages of the unique method of holding the putter and the elongated golf club putter describe in my above patent, several objects and advantages of the present invention are:

(a) to provide a putter that is used in a unique manner that improves accuracy in putting as a result of controlling alignment and direction while executing the putting stroke.

(b) to provide a putter that is used in a unique manner that improves distance control of each putt as a result of controlling the hitting force during the execution of the putting stroke.

(c) to provide a putter that is used in a unique manner that improves consistency in putting as a result of using a pendulum type stoke that employs the large muscles of the shoulders and arms.

(d) to provide a elongated golf club putter and putting method that conforms to the United States Golf Association (USGA) Rules of Golf.

(e) to provide a elongated putter that may be collapsed or disassembled when not in use to a conventional length putter for easy transport along with the other clubs used to play the game in accordance with the USGA Rules of Golf.

(f) to provide a putter that may be used as a conventional length putter when the elongated putter is disassembled.

Other objects and advantages will be more fully apparent from the appended claims.

DRAWING FIGURES

FIG. 1 is a front view of a golfer holding the elongated putter described by this invention.

FIG. 2-A is a front view of a golfer who is in his/her backswing in the act of putting with in elongated putter described by this invention.

FIG. 2-B is a front view of a golfer who is about to hit the golf ball in the act of putting with an elongated putter described by this invention.

FIG. 2-C is a from view of a golfer who has just hit the golf ball with an elongated putter described by this invention.

FIG. 3-A is a elongated collapsible putter showing the assembly of two shafts, a shaft extention, a internal plug, a elongated grip and the angle bent into the bottom of the shaft.

FIG. 3-B is a view of a elongated collapsible putter in the collapsed position.

FIG. 4-A is a two shaft design putter showing the assembly of two shafts, a treaded male screw, a female insert, two grips, and a angle bent into the bottom of the shaft.

FIG. 4-B is a enlarged view of insert and screw used to hold the two shafts together.

FIG. 4-C is a view of a two shaft design putter when disassembled.

REFERENCE NUMERALS IN DRAWINGS

| | |
|---|---|
| 1 | Golfer |
| 2 | Elongated Golf Club Putter |
| 3 | Grip End of Shaft |
| 4 | Putter Head |
| 5 | Golf Ball |
| 6 | Bottom Shaft |
| 7 | Upper Shaft |
| 8 | Shaft Joining Location |
| 9 | Extention Shaft |
| 10 | Dowel |
| 11 | Elongated Golf Grip |
| 12 | Offset Hole |
| 13 | Metal Plug |
| 14 | Grip Collar |
| 15 | Offset Angle |
| 16 | Top Shaft |
| 17 | Treaded Male Screw |
| 18 | Treaded Female Insert |
| 19 | Set Screw |
| 20 | Top Grip |
| 21 | Lower Grip |

DESCRIPTION—FIGS. 3 to 6

The present invention makes claim to a elongated golf club putter comprising a shaft constructed according to one of three different shaft designs with grip(s) and a putter head.

Figure 6:
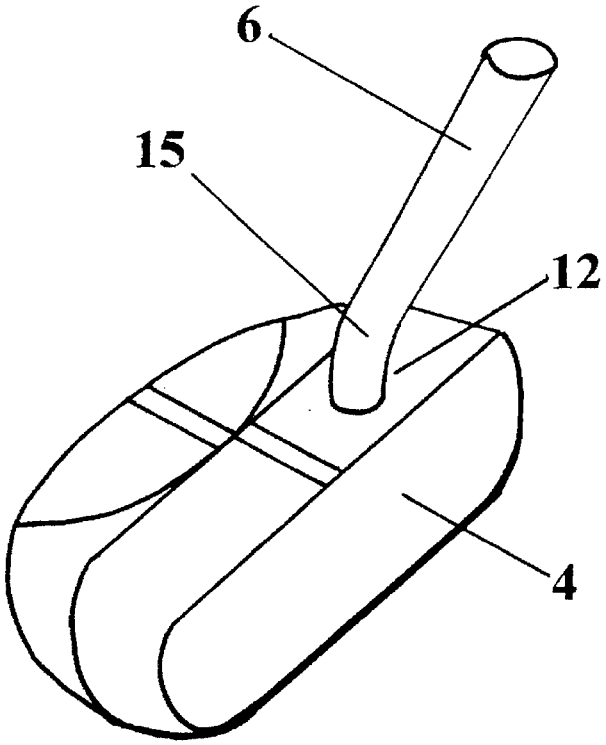
FIG. 6 is a front view of a standard heavy weight putter head and the first 3 inches of a shaft.

One design is a telescopic collapsible shaft design shown in FIG. 3-A and FIG. 3-B constructed by cutting a standard 41 inch stiff tapered shaft into two pieces and placing the smaller diameter bottom shaft 6 inside the larger diameter upper shaft 7. This results in creating a shaft whose overall length is 37 inches. When the lower shaft is fully extended, FIG. 3-A, the lower shaft becomes tightly joined 8 with the upper shaft because of the difference in shaft diameters due to the taper. In this elongated position the two shafts won't twist or bend due to the force from the weight of the putter head 4 and stiffness of the shaft. The elongated putter can be constructed to a desired length by adding a shaft extention 9 to the upper shaft resulting in an elongated length anywhere from 44 to 56 inches long, in 2 inch increments, and when collapsed anywhere from 34 to 46 inches long (standard lengths for "irons" and "woods" clubs). A hardwood dowel 10 is used in the connecting junction between the upper shaft 7 and the extention shaft 9. This junction is hidden under a single elongated golf grip 11 that is installed over the top end of the shaft and extends down 23 inches to where the user's hands hold the shaft when putting. A standard heavy weight (325 to 425 grams) putter head 4, shown in FIG. 6, is used in construction of the elongated putter. The putter head 4 is epoxied to the bottom end (0.390 diameter) of the shaft 6 by inserting the shaft into a offset hole 12 on the top of the putter head. A vertical offset angle 15 is built into the shaft 6 within 3 inches of the bottom end that is 30 degrees ±5 degrees offset from the center of the putter head face. Due to the longer length of the shaft from conventional putters, a larger/heavier putter head provides better match/balance for optimum performance. When not in use, the putter may be collapsed, FIG. 3-B, to standard club length by gently hitting the putter head 4 on the ground to separate the lower shaft 6 (that has the putter head attached) from the upper shaft 7. A metal plug 13 is permanently installed inside the upper shaft, under the grip 11, to serve as a stop for the lower shaft 6. A grip collar 14 is installed on the bottom of the grip 11 to dress off the end of the grip. In the collapsed position, FIG. 3-B, the telescopic putter is unusable because the lower shaft 6 (with the putter head 4) is not engaged with the upper shaft 7 and turns loosely in the upper shaft. This telescopic collapsible elongated putter design is the most beneficial to the golfer of all the design disclosed herein because it offers the unique method of putting (pendulum stroke) along with the ease of disassembly (collapsible) for transport between each hole on the golf course and for transport and storage off course.

Another design is a two shaft elongated putter design shown in FIGS. 4-A through C constructed by cutting two standard stiff tapered shafts 6 and 16 to the desired length and epoxing a treaded male screw 17 in the base of the top shaft 16 and epoxing a treaded female insert 18 in the top of the bottom shaft (similar to that found on a two piece "pool que stick"). This coupling type design, shown enlarged in FIG. 4-B, allows the golfer to assemble the elongated putter for use and disassemble the putter for transport by screwing the two shafts together and then, per USGA Rules of Golf, locking them with a allen wrench set screw 19. A standard 10 inch golf grip 20 fits over the top shaft at the top end and a standard 10 inch grip 21 fits over the lower shaft at the top end of the bottom shaft. A standard heavy weight (325 to 414 grams) putter head 4, shown in FIG. 6, is used in construction of the elongated putter. The putter head 4 is epoxied to the bottom end (0.390 diameter) of the shaft 6 by inserting the shaft into a offset hole 12 on the top of the putter head. A vertical offset angle 15 is built into the shaft 6 within 3 inches of the bottom end that is 30 degrees ±5 degrees offset from the center of the putter head face. Due to the longer length of the shaft from conventional putters, a larger/heavier putter head 4 provides better match/balance for optimum performance. The length of the two shaft putter design can be constructed anywhere from 44 to 56 inches long, in 2 inch increments. When disassembled, FIG. 4-C, the lower shaft 6 is designed to be 35 inches long (standard conventional putter club length) which allows for use as a regular length conventional putter and for easy storage and transport when not in use. Although this design offers the unique method of putting (pendulum type stroke) and the disassembly feature, it is not as beneficial to the golfer 1 as the collapsible design because the disassembly is not quick and easy (unscrew set screw then unscrew coupling) and would only be done for off course transport and storage.

Figure 5:
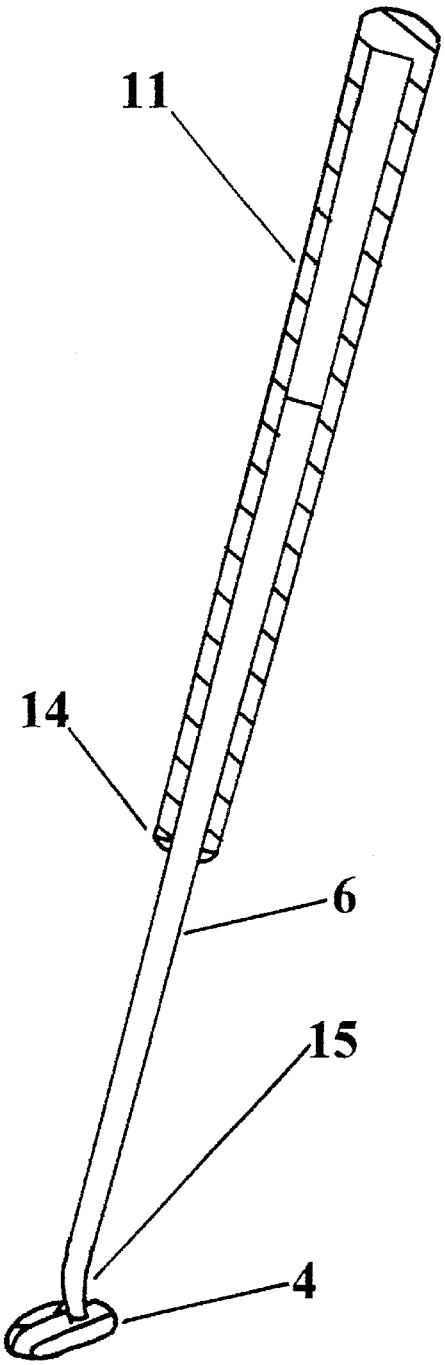
FIG. 5 is a single shaft design putter showing a shaft, a elongated grip and the angle bent into the bottom of the shaft.

The third design is the single shaft design shown in FIG. 5 that is constructed using a long stiff tapered shaft 6 cut to length, anywhere from 44 to 56 inches long, in 2 inch increments. A single elongated 23 inch golf grip 11 is installed over the top end of the shaft and extends down 23 inches to where the user's hands hold the shaft when putting. A grip collar 14 is installed on the bottom of the grip 11 to dress off the end of the grip. A standard heavy weight (325 to 425 grams) putter head 4 in FIG. 6 is used in construction of the elongated putter. The putter head is epoxied to the bottom end (0.390 diameter) of the shaft 6 by inserting the shaft into a offset hole 12 on the top of the putter head 4. A vertical offset angle 15 is built into the shaft 6 within 3 inches of the bottom end that is 30 degrees ±5 degrees offset from the center of the putter head face. Due to the longer length of the shaft from conventional putters, a larger/heavier putter head provides better match/balance for optimum performance. This design offers the unique method of putting (pendulum stroke) but it is the least beneficial to the golfer 1 of all the shaft designs because it cannot be disassembled for transport or storage.

OPERATION—FIGS. 1, 2

The elongated golf club putter and unique putting method is illustrated in a comprehensive view of the invention in FIG. 1. Shown is a front view of a right handed golfer 1 set in the proper putting stance with the elongated putter 2 held in the unique putting method where the grip end 3 of the shaft is in the left arm pit and the hands are holding the elongated shaft on the grip in the middle.

The present invention makes claim to a unique method of putting shown in FIGS. 2A–C wherein the golfer 1 shown in FIG. 2-A is in the process of putting and has moved the putter head 4 along a line away from the ball 5 (backswing) using a pendulum type stroke (pivoting the elongated putter with the grip end 3 stationary in the arm pit) such that the ball, when hit by the putter head 4, will move the desired distance along a predetermined line that will cause the ball to go into the cup on the green. In FIG. 2-B the golfer 1 has completed the backswing portion of the pendulum type stroke and has moved the elongated putter 2 forward to the point just before hitting the ball 5 with the putter head 4. In FIG. 2-C the golfer 1 has swung the elongated putter 2 forward through the impact zone, completing the pendulum type stroke, and has hit the ball 5 along the predetermined line towards the hole.

SUMMARY, RAMIFICATIONS, AND SCOPE

The invention is a elongated golf club putter that is designed to be used in a unique manner that provides more stability than conventional putters thereby achieving more control, better accuracy and consistency of use. The user assembles the putter prior to use on a golf course by, for the telescopic and two shaft putter designs, extending the shaft in a manner that meet the equipment rules defined by the United States Golf Association. This is done on the telescopic shaft design by holding the grip on the upper shaft and allowing the lower shaft, with the putter head, to fall by gravity, into its fully extended position. Once extended, it remains fixed in the extended position by friction. To transport the telescopic putter in a golf bag like the other clubs, the user can collapse the two shafts inside each other by gently hitting the putter head/lower shaft on the ground to loosen the friction connection with the upper shaft. On the two shaft putter design, to assemble the putter for use, the user screws the two shafts together (like a pool que stick) and locks them into place using a allen head set screw. Putting with the elongated putter, regardless of which shaft design is used, is done by placing the top end of the shaft, where the grip end is, in the left arm pit, or for taller players, up under the left arm against the side of the chest (for right hand players) and visa-versa for left handed players.

The hands are placed on the middle part of the shaft, over a grip, grasping the shaft in a manner similar to how one would hold a conventional putter. The putt is performed by utilizing a pendulum style putting stroke that utilizes the large shoulder muscles and arms. The hands remain quiet through the swing guiding the putter head along a line that will direct the ball into the hole.

The elongated golf club putter that is used in the unique manner of putting may be constructed in one of three ways. The first is a telescopic shaft design that utilizes a smaller diameter tapered shaft inside a larger diameter tapered shaft. This method of construction allows the user to elongate the putter for use and collapse the putter for transport by disengaging the friction connection between the smaller bottom shaft from the larger top shaft. A metal plug is epoxied inside the top shaft to serve as a stop for the bottom shaft when the putter is in the collapsed position. A elongated golf grip fits over the top end of the top shaft and extends down to where the user's hands hold the shaft when putting. A standard heavy weight putter head, with a offset hole on top, is epoxied to the bottom end of the lower shaft. A vertical offset angle, between the shaft and the putter face, is built into the bottom of the lower shaft.

Another method of construction is a two shaft design that has two tapered shafts joined together by a treaded screw coupling that allows the user to assemble the putter by screwing one shaft into the other. The top shaft has a treaded male screw epoxied into the smaller end and the bottom shaft has a treaded female insert epoxied into the larger end. This coupling method of construction is similar to that found on a two piece "pool que stick". A golf grip is installed over the top end of the top shaft and a grip is installed that over the top end of the bottom shaft where the user's hands hold the shaft when putting. A standard heavy weight putter head, with a offset hole on top, is epoxied to the bottom end of the lower shaft. A vertical offset angle, between the shaft and the putter face, is built into the bottom of the lower shaft.

A third method of construction is a single shaft design that is constructed using one long tapered shaft cut to length, anywhere from 44 to 56 inches long, in 2 inch increments. A elongated golf grip fits over the top end of the top shaft and extends down to where the user's hands hold the shaft when putting. A standard heavy weight putter head, with a offset hole on top, is epoxied to the bottom end of the lower shaft. A vertical offset angle, between the shaft and the putter face, is built into the bottom of the shaft.

Although the descriptions above contains many specificities, these should not be construed as limiting the scope of the invention but merely providing illustrations on some of the presently preferred embodiments of this invention. Thus the scope of this invention should be determined by the appended claims rather than the examples given.

I claim:

1. A golf club putter that is adjustable in the axial direction to a position of either fully elongated for putting or fully collapsed for transport in a golf carrying bag, comprising:

(a) a putter head having a flat forward surface, a top side, and a hole positioned offset of center on the top side for purposes of affixing a shaft; and (b) an elongated golf grip extending down from a top end of an upper shaft section in the axial direction to allow a golfer's hands to hold said elongated golf grip when putting; and (c) a metal plug that serves as a stop for a lower shaft section; and (d) an extention shaft for constructing said putter to a desired length installed in said top end of said upper shaft section (e) a dowel used to connect said upper shaft section and said extention shaft (f) a grip collar used to dress off an end of said elongated golf grip installed at a bottom of said elongated golf grip; and (g) said upper and lower shaft section, adjustable in the axial direction to a position of either fully elongated or fully collapsed wherein said lower shaft section is received in said upper shaft section for purposes of collapsing, wherein said lower shaft section, when fully extended from said upper shaft section, is secured by friction at a shaft joining location where a top of said lower shaft section makes contact with a bottom of said upper shaft section for purposes of elongating; and (h) a taper in the axial direction of said upper and lower shaft sections approximately one and one half times larger in diameter at the upper shaft section top end than the diameter of a lower shaft section bottom end; and (i) a bend within three inches of said bottom end of said lower shaft section of approximately 30 degrees when measured between a line extending axially downwardly along said upper shaft section and a line extending axially upwardly up from said bottom end of said lower shaft section when said lower shaft section is affixed to said putter head offset hole and said putter head is aligned along said intended line and said upper shaft section is in a golfer's forward armpit, whereby positioning the top end of said upper shaft section under a golfer's forward armpit while holding said putter approximately in the middle by the hands creates a pendulum type stroke when said putter is swung in a rearwards to forwards movement.

2. The putter of claim 1 wherein said putter head weighs between 325 grams and 425 grams.

3. The putter of claim 1 wherein said grip extends approximately 23 inches down from the top end of said upper shaft section.

4. The extention shaft of claim 1 wherein said putter length is constructed such that an elongated putter results in a length between 44 and 56 inches.

5. The putter of claim 1 wherein said dowel is made of hardwood.

* * * * *